US005522243A

United States Patent [19]

Kusmiss

[11] Patent Number: 5,522,243

[45] Date of Patent: Jun. 4, 1996

[54] DAYLIGHT FLUORESCENT COLOR COMBINATION LOCK WITH OPTIONAL ADDITIONAL INDICIA

[76] Inventor: John H. Kusmiss, 11160 Laugmuir Ave., Sunland, Calif. 91040

[21] Appl. No.: 157,919

[22] Filed: Nov. 24, 1993

Related U.S. Application Data

[63] Continuation-in-part of Ser. No. 913,817, Jul. 16, 1992, abandoned.

[51] Int. Cl.[6] ..... E05B 17/00

[52] U.S. Cl. ..... 70/330; 70/331; 70/332; 70/446; 434/113; 434/170; 434/402

[58] Field of Search ..... 70/26, 330–332, 70/445, 446; 434/113, 170, 206, 207, 402; D8/334, 335

[56] References Cited

U.S. PATENT DOCUMENTS

| | | | |
|---|---|---|---|
| 1,037,531 | 9/1912 | Ratcliff | 70/DIG. 59 X |
| 1,238,247 | 8/1917 | Baker et al. | 70/213 |
| 1,277,994 | 9/1918 | Mottola | 70/213 |
| 1,391,986 | 9/1921 | Smith | 434/402 |
| 2,503,044 | 4/1950 | Guerra | 70/454 |
| 3,536,017 | 10/1970 | Lucas | 434/113 X |
| 3,735,835 | 5/1973 | Thomas | 70/278 X |
| 3,775,775 | 12/1973 | Mazzenga | 2/80 |
| 4,146,978 | 4/1979 | Breslow | 434/402 X |
| 4,424,449 | 1/1984 | O'Brill | 40/542 X |
| 4,443,199 | 4/1984 | Sakai | 434/170 |
| 4,472,143 | 9/1984 | Bennett et al. | 70/89 X |
| 4,560,164 | 12/1985 | Darling | 70/289 X |
| 4,650,421 | 3/1987 | Anczurowski | 434/113 |
| 4,677,010 | 6/1987 | Selwyn | 40/299 X |
| 4,684,945 | 8/1987 | Sanderford, Jr. | 70/278 X |
| 4,829,794 | 5/1989 | Crown | 70/25 |

FOREIGN PATENT DOCUMENTS

| | | | |
|---|---|---|---|
| 964766 | 8/1950 | France | 70/26 |
| 1078189 | 11/1954 | France | 434/402 |
| 2011145 | 7/1979 | United Kingdom | 434/113 |

*Primary Examiner*—Llyod A. Gall

[57] ABSTRACT

An improved combination lock includes a plurality of patches of different daylight fluorescent colors with or without additional nonnumerical indicia, for indicating a predetermined combination. Alternatively, the patches can all be of the same fluorescent color and used as a contrasting background for the additional nonnumerical indicia. The additional nonnumerical indicia can comprise different geometrical patterns including sets of at least three parallel lines, or pictures of different animals. The indicia are preferably made larger than is conventional.

1 Claim, 2 Drawing Sheets

DAYLIGHT FLUORESCENT COLOR COMBINATION LOCK WITH OPTIONAL ADDITIONAL INDICIA

This application is a continuation-in-part of application serial number 07/913,817 filed Jul. 16, 1992, now abandoned.

The present application is related to U.S. design patent application Ser. No. 29/015,711, filed Nov. 24, 1993.

BACKGROUND OF THE INVENTION

One form of conventional combination lock makes use of numerals in the form of the digits from 0 to 9 to indicate the position of the rotatable wheels whose relative orientations determine whether the lock is open or closed. Another common form of conventional combination padlock uses a rotatable inner part mounted in an outer housing with numerical indicia on one part and an indexing mark on the other; the open condition is achieved by sequentially rotating the inner part with respect to the housing in opposite clock senses so that the proper numbers line up with the indexing mark on the housing. A typical combination for such a lock might be 28 clockwise, 35 counterclockwise, and 17 clockwise, for example.

Such conventional locks using numerical indicia as the key to their operation are difficult to use for certain classes of people, namely for the farsighted or otherwise visually handicapped, and for those persons who have difficulty remembering numerical combinations. The latter class would include persons suffering various types of mental impairment, such as the retarded or very old, or young children who are not yet familiar with numbers. In addition, even some persons in the prime of life and not afflicted with any noticeable handicap have difficulty remembering numbers.

Probably the largest group of people who have difficulty using the conventional numerical combination padlock includes the large number of middle-aged men and women whose visual acuity has begun to decline. The loss of ability to see in dim light and the need to hold printed text far away to bring it into focus is familiar to everyone who reaches the age of 45 or so. A far-sighted person who has finished working out at a health club or gymnasium and has to fumble with a conventional lock with its typically small numbers in dim light, and in addition has trouble remembering the proper combination, knows the frustration involved.

There has been a long-felt need for a type of combination lock whose key is linked not with numbers, but with other forms of indicia which are easier to see and/or remember.

U.S. Pat. No. 4,560,164 to Darling concerns the cryptographic art and in particular deals with the problem of making mechanical puzzles more challenging and difficult to solve. Darling characterizes one of the deficiencies of the art in which he was working as "fixed connections [which] limited the number of variations which could occur in positioning or rearranging the various sub-elements, thereby limiting the difficulty of solving the puzzle." (Darling, column 1, lines 40–43). He goes on to explain that "[o]ne object of this invention is to provide a means of varying the connection among the various sub-elements of a cryptographic device so as to increase the variations which can occur in rearranging the various sub-elements" (col. 1, lines 43–47). FIG. 13 of Darling depicts an alternate embodiment of his invention "suitable for actuating a locking mechanism," as he states in lines 62 and 63 of column 15. Earlier, in describing his "tubular, puzzle type of cryptographic device" (col. 1, lines 6 and 7), Darling states that "[t]he first stepped portion 52 of stepped ring 50 has a surface, which is preferably the outside or external surface, on which numbers, letters, symbols, colors, or other indicia 56 are located." (col. 6, lines 38–41).

U.S. Pat. No. 3,735,835 to Thomas discloses a locking means having "a cylindrical portion 112 marked with ciphers e.g. digits" (col. 2, lines 24 and 25). Thomas further discloses that "[t]o facilitate use at night, the ciphers may be marked in luminous or fluorescent paint material." (col. 3 lines 43–45). This apparently refers to the type of luminous paint employed in objects that glow in the dark and which commonly use a radioactive material mixed in a medium that emits light in response to absorption of the radioactive emissions. Thomas suggests that the "use at night" of a lock mechanism with conventional numerical indicia can be facilitated by marking the digits in luminous paint material so that they can be seen in the dark, as are the dials of a luminous wristwatch.

U.S. Pat. No. 1,238,247 to Baker et al. discloses a steering control lock for automobiles with a plurality of locking collars having "external characters" which are geometrical shapes (as shown in FIG. 1), such as circles, squares, and triangles.

U.S. Pat. No. 3,775,775 to Mazzenga is directed to a device for designating matching garments of a coordinated set of wearing apparel. Matching garments are identified with identical indicia, and Mazzenga depicts animal designs for the indicia in the case of children's clothes. Mazzenga explains pan of the rationale for his invention as follows:

> Children, however, frequently encounter difficulty in selecting the appropriate matching garments of a coordinated set as a result of their inexperience in discerning the minor differences which may distinguish the color, pattern and design of the respective garments. [Mazzenga, column 1, lines 11–16]

U.S. Pat. No. 1,391,986 to Smith is directed to an "educational appliance" intended to solve the problem of assisting "children . . . to spell words, to associate words with pictures appropriate thereto, to place parts of pictures in proper relation to form complete pictures, to add different sums and to spell different words . . . " (Smith, col. 1, lines 14–20). Smith states that ". . . I prefer to form pans of each picture on two or more adjoining [rotatable] sections 2 . . . " (col. 2, lines 93–95). Smith's preference is clearly depicted in his FIG. 1.

U.S. Pat. No. 4,443,199 to Sakai is directed to "a teaching method and aid for teaching the pronunciation and spelling of any language . . . " (col. 2, lines 27–29). Sakai makes use of a "first set of displaceable units" which "visually or tangibly, individually, prominently, carry alphabet letters of the language" and a "second set of displaceable units" some of which "are individually colored to indicate a phonetic vowel of the language and others which are formed into different geometric shapes to represent specific consonants and diagraphs of the language." (col. 2, lines 54–61).

U.S. Pat. No. 4,650,421 to Anczurowski is directed to a method of representing colors to a blind person. Anczurowski uses combinations of sets of parallel straight lines which can be felt by the blind person because of being raised above a surface the color of which is being represented.

U.S. Pat. No. 4,684,945 to Sanderford is directed to an electronic lock controlled through a keyboard, the keys of which bear conventional numerical indicia (as shown for example, in FIG. 1).

French Pat. No. 1,078,189 is directed to an improved coin bank with a plurality of rotatable ring sections whose orientation locks or unlocks the bank. Two of the ring sections bear numbers and playing card suit symbols, while the rest bear parts of a comprehensive scene or design which becomes recognizable when the bank is in the unlocked position. None of the references described above discloses a combination lock bearing patches of daylight fluorescent colors with or without additional nonnumerical indicia to produce a combination lock that is easier for people to use and to see in daylight or under artificial lighting conditions.

SUMMARY OF THE INVENTION

The invention comprises a lock means for locking two structural entities together with combination means on the lock means for opening the lock means, including indicia means for indicating a predetermined combination of nonnumerical indicia by which the lock means may be unlocked. The indicia means comprises a plurality of patches of daylight fluorescent colors, with or without additional nonnumerical indicia which may include different geometrical patterns including sets of parallel lines, or pictures of different animals.

The lock means comprises any type of conventional combination lock. In one implementation an inner portion is rotatable inside an outer housing, with sequential positioning of the inner portion with respect to the outer housing in accordance with a predetermined sequence of relative orientations of the inner portion and the outer housing serving to unlock the lock. A second implementation includes a plurality of individually rotatable portions; the rotation of the portions to a predetermined configuration of relative orientations of the portions with respect to each other serves to unlock the lock. Other implementations include electromechanical or electronic combination locks utilizing a keypad with combination indicia on it. Here the indicia can comprise colors, either daylight fluorescent or ordinary, with or without additional nonnumerical indicia.

The invention also encompasses a method of providing an improved combination lock by utilizing nonnumerical indicia for indicating a key combination, comprising the steps of providing that part of the lock mechanism for locking and unlocking with appropriately located patches of daylight fluorescent colors, with or without additional nonnumerical indicia; whereby setting a predetermined spatial configuration of the colors or additional indicia will unlock the lock and setting the mechanism to a spatial configuration of the colors or additional indicia unlike the predetermined spatial configuration will lock the lock.

The novel features which are characteristic of the invention will be better understood from the following description in connection with the accompanying drawings. It should be appreciated, however, that each of the drawings is given for the purpose of illustration and description only and that the drawings are not intended to be a definition of the limits of the present invention.

DETAILED DESCRIPTION OF THE PREFERRED EMBODIMENTS

Figure 1:
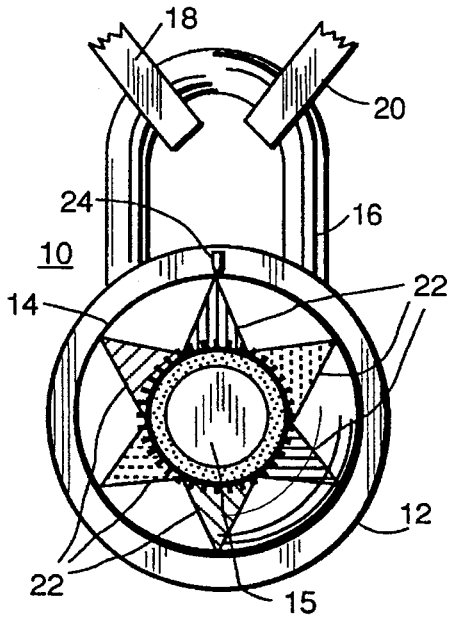
FIG. 1 is a top plan view of a first embodiment of the invention comprising a first type of combination lock with nonnumerical indicia comprising patches of different daylight fluorescent colors, the different colors being represented by different types of cross-hatching.

Referring to FIG. 1, a first embodiment 10 of the invention comprises a combination lock in the form of a padlock of a type commercially available in hardware and other stores, including an outer housing 12, an inner rotatable portion 14 with knob 15, and a locking member 16 which can be engaged in housing 12 to secure two structural elements 18 and 20 together. Nonnumerical indicia 22 on inner portion 14 serve to indicate the combination which will open the lock. Thus, lining up, in sequential opposite rotations of inner portion 14, three of nonnumerical indicia 22 with some fiducial mark 24 on outer housing 12 brings the internal lock mechanism into a condition in which locking member 16 can be released on one side from outer housing 12 so that elements 18 and 20 can be separated from each other. The construction of the internal lock mechanism is well known in the art and will not be described here.

Figure 2:
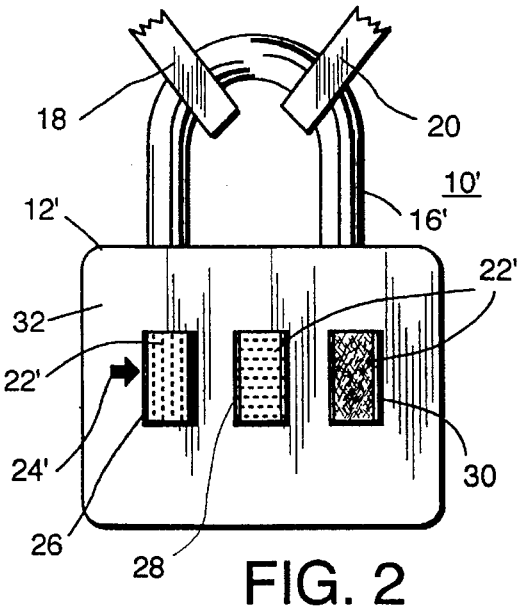
FIG. 2 is a top plan view of a second embodiment of the invention comprising a second type of combination lock with nonnumerical indicia comprising patches of different daylight fluorescent colors, the different colors being represented by different types of cross-hatching.

Referring to FIG. 2, a second embodiment 10' of the invention comprises a combination lock in the form of a padlock of another type commonly available, in which three rotating portions 26, 28, and 30 in an outer housing 12' serve to indicate the condition of an inner lock mechanism as being in a locked or unlocked state. The orientations of rotating portions 26, 28, and 30 are indicated by which of a plurality of nonnumerical indicia 22' are visible at a front surface 32 of outer housing 12'. As before, a locking member 16' is engaged on both sides by housing 12' to perform a locking function or is disengaged on one side to allow unlocking.

A variety of nonnumerical indicia 22 or 22' are suitable for various classes of users of combination locks 10 or 10'. One rationale for choosing one kind of indicia over another would be to serve the particular needs of the user. Thus, for example, relatively large patches of different daylight fluorescent colors would be appropriate for both the visually handicapped and those unfamiliar with, or intimidated by, numbers. Colors have an additional advantage in being recognizable to illiterates.

As shown in FIG. 1, the nonnumerical indicia 22 may be patches of daylight fluorescent colors in the shape of isosceles "triangles" spaced around the periphery of inner portion 14, with the apex defined by the two equal-length sides of each triangular patch being closest to the outer periphery of inner portion 14. The base of each "triangle" is curved. This arrangement has the advantage that a relatively large area of color can be included in a patch while still maintaining a well defined position associated with the patch that can be lined up precisely with the fiducial mark 24 on outer housing 12. An even larger area per patch could be attained by curving the equal-length sides outward while keeping the length of the third side unchanged.

As shown in FIG. 2, the nonnumerical indicia 22' may be patches of daylight fluorescent colors on rotating portions 26, 28, and 30 of combination lock 10'.

The daylight fluorescent colors are vividly and strikingly visible due to dyes contained therein which absorb ultraviolet radiation contained in daylight (or the light from fluorescent or incandescent lighting) and re-emit visible light as fluorescence radiation. Colors available as fluorescent include red, blue, orange, green, pink, yellow, and magenta, as well as various shades thereof. A daylight fluorescent version of white (which of course includes all colors) also exists. Black or brown can also serve as indicia which contrast with the daylight fluorescent indicia.

Figure 3:
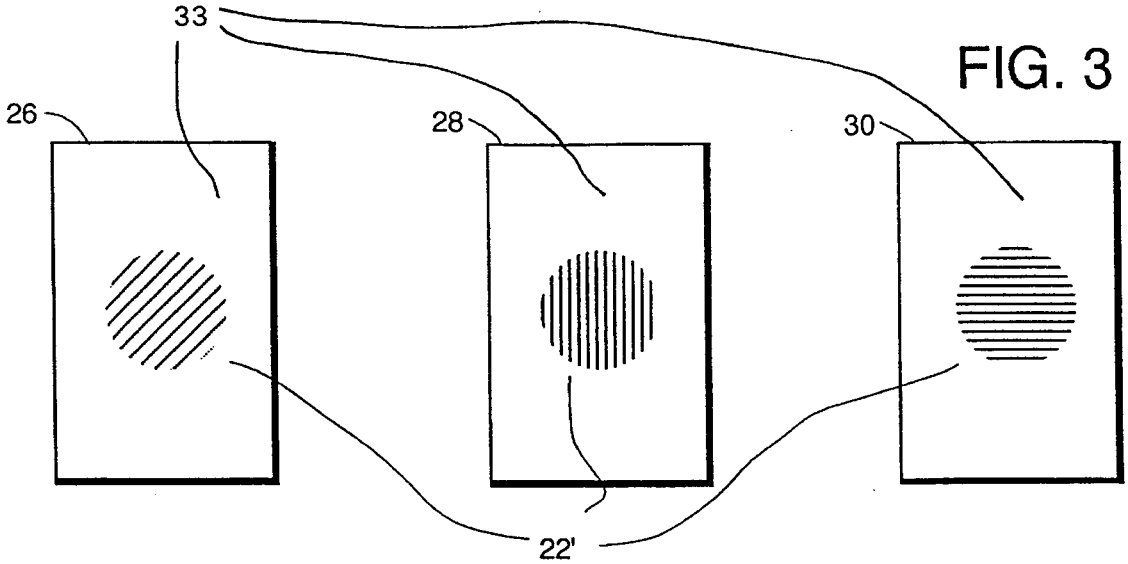
FIG. 3 is a top plan view of the plurality of rotatable portions of the combination lock of FIG. 2 showing backgrounds of one daylight fluorescent color bearing additional nonnumerical indicia.

Instead of patches of different daylight fluorescent colors, one particular daylight fluorescent color may be used as a contrasting background for additional nonnumerical indicia. For a background of a light daylight fluorescent color such as yellow the additional indicia could be colored black, and for a dark daylight fluorescent color such as blue the additional indicia could be colored white. FIG. 3 shows one type of additional nonnumerical indicia 22' that may be used on a fluorescent color background 33, comprising different types of geometrical patterns including at least one set of parallel lines, the at least one set having at least three such lines.

Still another type of additional nonnumerical indicia 22' might be outlines of different types of animals. Suitable mammals might include the cat, dog, mouse, kangaroo, elephant, giraffe, monkey, hippopotamus, lion, porcupine, whale, and dolphin. Other types of animals such as birds, fishes, reptiles, amphibians, and insects readily come to mind as suitable also.

Figure 4:
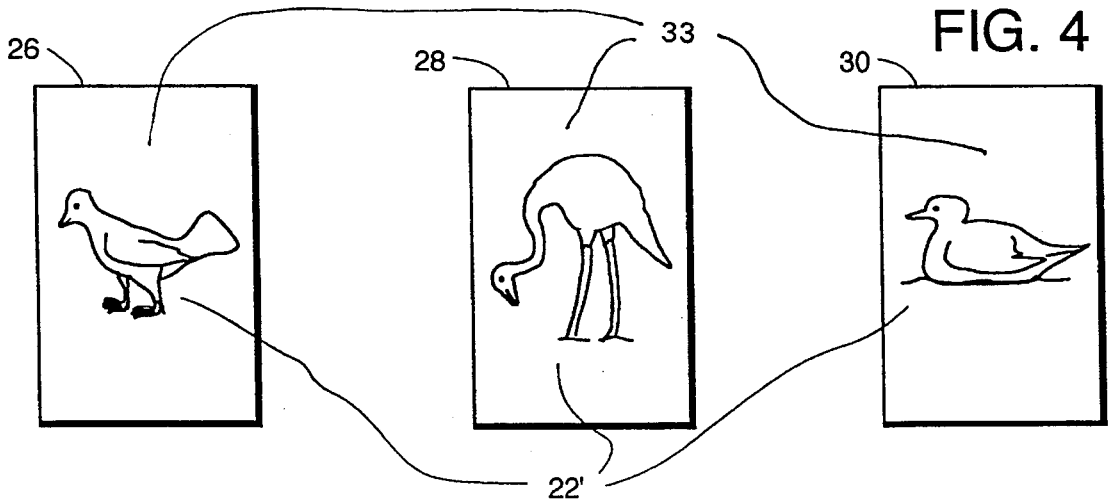
FIG. 4 is a top plan view of the plurality of rotatable portions of the combination lock of FIG. 2 showing a different type of additional nonnumerical indicia that may be used.

FIG. 4 shows additional nonnumerical indicia 22' that may be used on a fluorescent color background 33 comprising outlines of different types of birds. Suitable birds would include those having markedly different shapes, such as the owl, the seagull, the flamingo, the stork, the eagle, the sparrow, the pigeon, and the crow.

Figure 6:
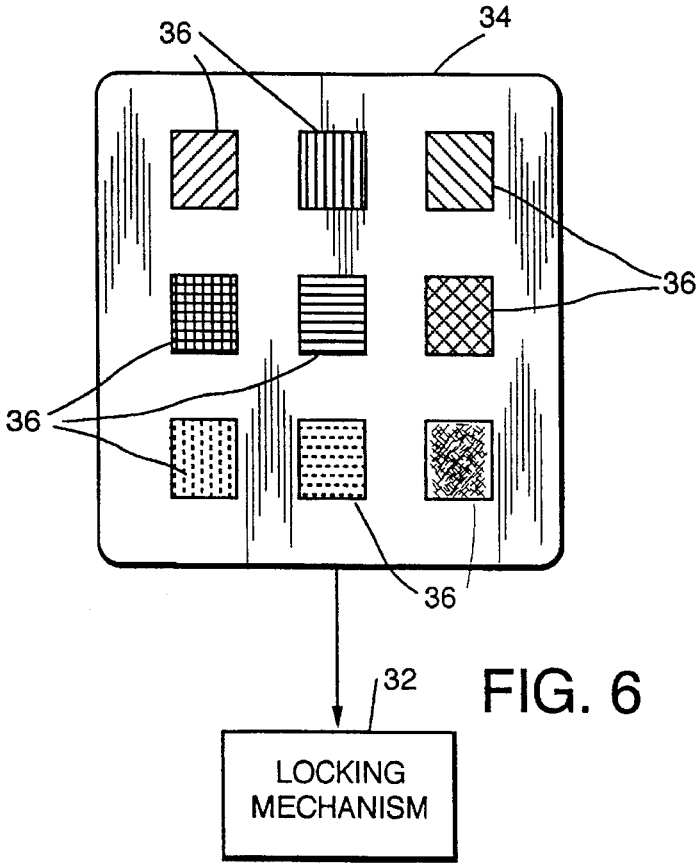
FIG. 6 is a top plan view of an alternative embodiment of the invention comprising a locking mechanism 32 controlled by a keypad 34 including keys 36 each bearing a different color (the different colors being represented by different types of cross-hatching).
Figure 5:
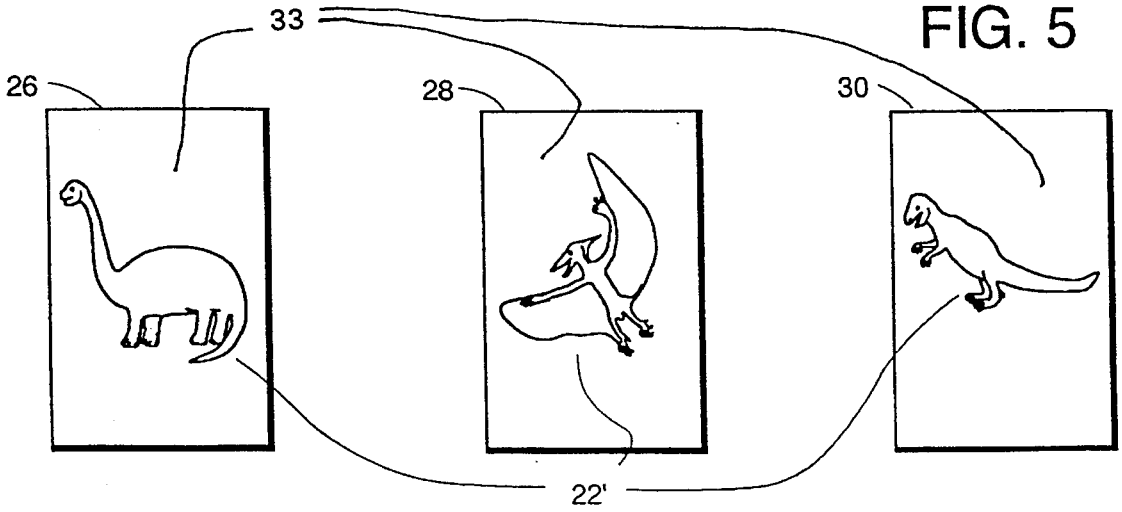
FIG. 5 is a top plan view of the plurality of rotatable portions of the combination lock of FIG. 2 showing a different type of additional nonnumerical indicia that may be used.

FIG. 5 shows yet one more different type of additional nonnumerical indicia that may be used, comprising outlines of different types of prehistoric animals including the brontosaurus, tyrannosaurus, and pterodactyl. A combination lock specifically geared toward use by children could employ just these three different indicia with three rotatable tumbler wheels, which would still allow for 3×3×3=27 different combinations. Absent a child genius who could realize a solution by the systematic exhaustion of possibilities, a kindergartner's cookies would probably be safe in a lunchbox featuring such a combination lock. Even if the child's environment is sufficiently ideal to obviate such paranoid measures, familiarization with a lock in accordance with the present invention will be a valuable education for the child in preparation for the normally less ideal conditions of adolescence and adulthood. There are, of course, other types of combination locks well known in the art in addition to the ones mentioned above. For example, there are electrical or electromechanical combination locks making use of a keypad bearing the combination indicia, as shown in FIG. 6. The principles of the present invention are readily applicable to these other types of locks by using the nonnumerical indicia described herein. Thus, in FIG. 6 a locking mechanism 32 controlled by a keypad 34 includes keys 36 each bearing a different color (the different colors being represented by different types of cross-hatching). The colors can be of the ordinary variety or of the daylight fluorescent kind. Different shades of one particular color, either ordinary or fluorescent, could also be employed. In implementing the nonnumerical indicia of the improved combination lock of the present invention, several different methods will be readily apparent to one ordinarily skilled in the art. In using different colors or configurations of colors as the nonnumerical indicia, the colors can be an integral part of the structure, as in colored plastic parts, or can be paints or painted sheet-like materials applied to structural parts of the lock. For other kinds of nonnumerical indicia one can distinguish between forming the indicia in the surface of the structural material versus printing them on the surface or applying printed sheet-like layers to the surface. In forming the indicia in the surface there is also a choice between engraving them or forming them in bas-relief. With respect to all the different possible types of nonnumerical indicia described above, it is distinctly advantageous to make them as large as possible relative to the other parts of the lock to accommodate the needs of visually impaired people. If the indicia are chosen to be colors, it would obviously be a good idea to choose those colors which are not confused by people who suffer from different types of color blindness, insofar as that is practically possible. On the other hand, for people with an acute sense of color discrimination, it would be possible to choose fine gradations of the same color, to the point where a person with only average color discrimination would be severely challenged by the cognitive problem inherent in reproducing the correct combination of color shades to unlock the lock.

The invention also encompasses a method of providing an improved combination lock by utilizing nonnumerical indicia for indicating a key combination, comprising the steps of providing that part of the lock mechanism for locking and unlocking with appropriately located patches of daylight fluorescent colors, with or without additional nonnumerical indicia; whereby setting a predetermined spatial configuration of the colors or additional indicia will unlock the lock and setting the mechanism to a spatial configuration of the colors or additional indicia unlike the predetermined spatial configuration will lock the lock.

Those having skill in the arts relevant to the present invention will undoubtedly think of various obvious modifications or additions to the invention based upon the embodiments disclosed herein. For example, although certain types of combination padlocks have been shown and described to illustrate the invention, a wide variety of other types of combination lock types and lock mechanisms which are well known in the art could be employed. Also, there is wide latitude in choosing the set of additional nonnumerical indicia from which the key combination is constructed. For example, for Japanese users of the invention, a set of the Hiragana or Katakana could be employed. These phonetic symbols might be used to spell a particular Japanese word that is the combination for the lock. The invention is not to be limited to the disclosed embodiment, but is to be limited only by the scope of the following claims.

I claim:

1. A combination lock comprising:

lock means for locking two structural entities together, with combination means on said lock means for opening said lock means, said combination means including indicia means for indicating a predetermined combination of nonnumerical indicia by which said lock means may be unlocked, wherein said indicia means includes a plurality of colored portions of said lock means, wherein said colored portions include daylight fluorescent colors and wherein said colored portions facilitate opening said lock under daylight or indoor artificial lighting conditions by persons having impaired vision or having difficulty remembering, or unfamiliarity with, numbers; wherein said lock means includes a rotatable inner portion with said colored portions on said inner portion, said inner portion being inside an outer housing, and wherein the sequential positioning of said inner portion with respect to said outer housing in accordance with a predetermined sequence of relative orientations of said inner portion and said outer housing serves to unlock said lock, and wherein said colored portions comprise isosceles triangular segments disposed in a circular arrangement on said inner portion, with an apex of each said triangular segment pointing radially outward toward said outer housing, and wherein the sequential positioning, in opposite rotations, of the apexes of three predetermined said triangular segments opposite a fiducial mark on said outer housing serves to unlock said lock.

* * * * *